US005868917A

United States Patent [19]

Benaben

[11] Patent Number: 5,868,917

[45] Date of Patent: Feb. 9, 1999

[54] PROCESS FOR THE ELECTRODEPOSITION OF A CHROMIUM COATING CONTAINING SOLID INCLUSIONS AND PLATING SOLUTION EMPLOYED IN THIS PROCESS

[75] Inventor: Patrick Benaben, L'Horme, France

[73] Assignee: Floquet Monopole, Poissy, France

[21] Appl. No.: 548,976

[22] Filed: Oct. 27, 1995

[30] Foreign Application Priority Data

Oct. 28, 1994 [FR] France ..... 94 12981

[51] Int. Cl.[6] ..... C25D 15/00; C25D 5/00; C25D 3/06

[52] U.S. Cl. ..... 205/109; 205/110; 205/111; 205/112; 205/287

[58] Field of Search ..... 205/109, 110, 205/111, 112, 287

[56] References Cited

U.S. PATENT DOCUMENTS

| | | | |
|---|---|---|---|
| 1,098,066 | 12/1914 | Kampschulte et al. . | |
| 3,061,525 | 10/1962 | Grazen | 205/109 |
| 3,844,910 | 10/1974 | Lipp et al. | 205/109 |
| 3,917,517 | 11/1975 | Jordan et al. | 205/243 |
| 4,612,091 | 9/1986 | Benaben et al. | 205/287 |
| 4,846,940 | 7/1989 | Neuhauser et al. | 205/109 |

FOREIGN PATENT DOCUMENTS

| | | |
|---|---|---|
| 0217126 | 9/1986 | European Pat. Off. . |
| 0099793 | 4/1987 | European Pat. Off. . |
| 1220331 | 4/1967 | United Kingdom . |
| 1380055 | 11/1971 | United Kingdom . |
| 1380055 | 1/1975 | United Kingdom . |

OTHER PUBLICATIONS

Takaya et al., "Trivalent Chromium Composite Coatings Containing Silicon Carbide or Diamond Particles", Plating & Surface Finishing, 74(9), 70–72, Sep. 1987.

Patent abstracts of Japan, vol. 18, No. 572 (M–1696) Nov. 2, 1994 & JP–A–06210306 (Nippon Steel Corporation) Aug. 2, 1994—Abstract.

Metal Finishing, vol. 64, No. 6, Jun. 1996, USA pp. 107–109, Dominikov "Plating from trivalent chromium solutions".

Plating & Surface Finishing, vol. 74, No. 9, Sep. 1987, USA pp. 70–72, Takaya "Trivalent chromium composite coatings containing silicon carbide or diamond particles" p. 70; table 1.

*Primary Examiner*—Kathryn L. Gorgos
*Assistant Examiner*—Edna Wong
*Attorney, Agent, or Firm*—Henderson & Sturm

[57] ABSTRACT

Process suitable for providing a substrate with a protective coating based on chromium, including a chromium matrix in which solid particles are distributed. The process includes a step of electrodeposition of the coating carried out by passing an electric current between a cathode or cathodes of the substrate to be coated and an anode or anodes. The cathode(s) and anode(s) are immersed in an electroplating solution, wherein the electroplating solution is based on an aqueous solution including trivalent chromium obtained from the reduction of chromic acid by a reducing agent, and contains solid particles.

12 Claims, 7 Drawing Sheets

PHOTO 1

PHOTO 2

PHOTO 1

PHOTO 2

PHOTO 3

PHOTO 4

PHOTO 5

PROCESS FOR THE ELECTRODEPOSITION OF A CHROMIUM COATING CONTAINING SOLID INCLUSIONS AND PLATING SOLUTION EMPLOYED IN THIS PROCESS

BACKGROUND OF THE INVENTION

1. Field of the Invention

The subject of the invention is a process for the electrodeposition of a chromium coating containing solid inclusions; the aim of the invention is also to provide the plating solution employed in this process.

Chromium electroplating is used because of the improvement in the physical surface properties which it provides when it is used. In particular, these improvements are significant, without this list being limiting, in the fields of:

wear and abrasion resistance, corrosion resistance, coefficient of friction hardness.

It is for these various reasons that chromium electroplating is used when components are in a frictional environment or exposed to certain chemical attacks or when it is necessary to maintain a shiny and smooth surface finish.

It has been known for a long time that it is possible to modify the characteristics of certain metal platings (copper and nickel deposited electrolytically and chemically, for example) by codepositing particles of variable size and nature, and to do so according to the characteristics which it is sought to improve.

2. Description of the Prior Art

Many authors have described the codeposition in nickel and copper platings of particles of oxides, carbides, nitrides, metallic borides and organic compounds of a size varying from a few ångströms to a few tens of microns. They have demonstrated the overall advantage of this, in particular in the fields of wear resistance, improvement to the coefficient of friction, and corrosion resistance.

In this regard, an appreciation of the methods used and of the results obtained is given in the literature. For example, U.S. Pat. No. 3,844,910 describes a process for obtaining nickel and cobalt coatings containing, as solid inclusions, silicon carbide in the presence of aminosilicates.

The application of this technique to chromium plating therefore seem to be entirely indicated since it should provide the same type of improvement to these layers, the physical properties of which, before the addition of particles, are in many fields superior to those obtained with the aforementioned metals containing inclusions.

In fact, it is also known, although more difficult to implement, to be able to codeposit as inclusions, in chromium plating solutions, various types of particles of variable size. Some authors describe production methods and the physical characteristics of the platings obtained.

By way of example, U.S. Pat. No. 1,098,066 describes a method of obtaining a chromium coating containing, as solid inclusions, aluminum oxide, titanium oxide or a mixture of $Ca_2Al_2Si_3O_8$ and of $Al_2O_3 \cdot 2SiO_2$. This coating is produced by electrodeposition from a plating solution comprising chromium in the oxidation state VI. In the examples given in this patent, the chromium in the oxidation state VI comes from chromic anhydride.

Likewise, GB Patent 1,220,331 describes a process for obtaining a coating consisting of a chromium matrix containing, as solid inclusions, ceramic particles, metal particles or a mixture of metal particles and ceramic particles. Here too, this coating is produced by electrodeposition from a solution comprising chromium in the oxidation state VI. In the example given in this patent, the chromium in the oxidation state VI comes from chromic acid.

However, all such platings of chromium layers with inclusions of particles are produced using solutions of hexavalent chromium (chromium in the oxidation state VI), in particular aqueous solutions of chromic anhydride ($CrO_3$), these solutions varying in the nature of the catalysts used. The differences in the methods, apart from the nature of the catalysts, are essentially due to the conditions of use:

very high current density, use of addition cations, periodic reversal and codeposition during the anodic phase, as described in Patents EP 0 217 126 and U.S. 4 846 940.

Drawbacks arise insofar as:

the results are not reproducible in the majority of cases, this being so even by using the same experimental conditions, the inclusions are not distributed homogeneously in the plating; they are often concentrated in the plating cracks caused by the relieving of internal stresses and their opening during the anodic phase (in processes using periodic current reversal). This heterogeneous distribution of the particles can introduce malfunctions prejudicial to the characteristics which it is sought to improve, the concentration of included particles remains limited to a few percent, these methods require a lengthy and expensive preparation of the particles.

However, despite all these imperfections in the platings obtained, despite the fact that the hexavalent chromium solution is very toxic (in terms of disposal, the toxicity is classified as equivalent to cyanides) and despite the fact that this codeposition is difficult, the improvements in the physical properties of the chromium depositions with inclusions obtained are such that they justify the industrial use thereof.

There is therefore a major industrial advantage in being able to codeposit, homogeneously, reproducibly and simply, particles of different size and nature depending on the properties which it is sought to improve.

This advantage would be even greater if it were possible to avoid the use of solutions of chromic acid, which is a strong and highly oxidizing acid (and therefore dangerous to use) and above all, is carcinogenic and highly toxic.

The development of a process allowing the use of a trivalent chromium solution as electroplating solution for the codeposition of particles in chromium platings would therefore seem to be of great utility, insofar as trivalent chromium solutions are reputed to be less toxic (the toxicity of trivalent chromium solutions is of the same order of magnitude as that of the usual metals) and insofar as, in addition, for the same current efficiency (Faraday yield), the rate of deposition of chromium from a trivalent chromium solution is twice as rapid as that obtained using a hexavalent chromium solution. In other words, for the same current efficiency (for example 25%), for a current density of 50 A/dm$^2$, the rate will be of the order of 1 $\mu$m/min for a plating obtained using a hexavalent chromium solution, as it will be twice that (2 $\mu$m/min) for a trivalent chromium solution.

Many patents and publications describe methods for allowing layers of chromium to be obtained by electroplating from trivalent chromium solutions, the solutions in question not comprising particles. To our knowledge, the only existing industrial applications are in the field of decorative chromium. Very few publications or patents take account of the possibility of obtaining thick, hard and dense layers; generally the layers obtained are friable, adhere poorly or have a hardness of the order of 700 Hv/100 g and, in any case, markedly inferior to the hardness (of the order of 1000 Hv/100 g) of the chromium obtained from hexavalent chromium plating solutions.

It will be recalled that Hv is the "Vickers hardness", a unit of force by which the hardness of the substrate is expressed.

Among these few written documents, Patents EP 0,099,793 and U.S. Pat. No. 4,612,091 describe a method allowing thick and hard layers of chromium to be deposited by using a trivalent chromium solution obtained by reduction of hexavalent chromium by means of a reducing agent chosen, inter alia, from alcohols, hydrogen peroxide, hyposulfites and sulfur dioxide, these solutions containing no complexing agents. In these patents, hydrohalic aqueous solutions are used as reaction medium. Moreover, it has also been shown that other media, (instead of hydrohalic compounds) could be used for the reduction, for example: sulfates, nitrates, fluoborates and organic acids, without this list being limiting.

To the knowledge of the Applicant Company, there are no publications or patents describing a process and/or a plating solution enabling chromium and particles of any kind whatsoever to be codeposited by means of an aqueous trivalent chromium solution obtained by reduction of chromic acid.

The Applicant Company has carried out various types of tests in order to examine the possibilities of codeposition of particles in a chromium plating from a trivalent chromium solution, the chromium being obtained by reduction of chromic acid, and, to do this, it has attempted to codeposit particles of different kinds and sizes in trivalent chromium solutions obtained by reduction by means of reducing agents such as alcohols, hydrogen peroxide, hyposulfites and sulfur dioxide in hydrohalic acid, sulfuric acid or organic acid (formic or acetic acid) medium, without this list being limiting.

Since in general trivalent chromium is more difficult to deposit than hexavalent chromium and since it is difficult to obtain a composite coating of sufficient quality from a solution containing hexavalent chromium and uncharged particles, the electrolysis of these aqueous trivalent chromium solutions obtained by reduction of chromic acid, to which the particles of kinds and of sizes to be tested had been added, has surprisingly enabled the Applicant Company to obtain dense, adherent, semi-bright, smooth and hard (hardness greater than 1000 Hv/100 g) and non friable layers which appear to be metallic chromium layers containing particles as inclusions when the plating is carried out on a substrate, this substrate being placed as the cathode.

SUMMARY OF THE INVENTION

It follows that the process in accordance with the invention, suitable for giving a substrate a protective coating based on chromium, comprising a chromium matrix in which solid particles are distributed, the said process including a step of electrodeposition of the said coating carried out by passing an electric current between the cathode or cathodes comprising the substrate to be coated and the anode or anodes, the said cathode(s) and anode(s) being immersed in an electroplating solution, is characterized in that the electroplating solution is based on an aqueous solution comprising trivalent chromium obtained from the reduction of chromic acid by a reducing agent, this plating solution containing solid particles.

DESCRIPTION OF THE PREFERRED EMBODIMENTS

According to an advantageous embodiment, the plating solution employed contains trivalent chromium with a concentration of between 5 and 150 g per liter of plating solution and preferably between 25 and 50 g per liter of plating solution, solid particles with a concentration of between 1 and 100 g per liter of plating solution and preferably between 5 and 50 g per liter of plating solution.

In addition, the electroplating solution is advantageously stirred and/or the temperature of the plating solution is fixed between 20° and 60° C. and preferably between 40° and 55° C. and/or the current density is maintained at a value of between 5 and 150 A/dm$^2$ and preferably between 30 and 80 A/dm$^2$.

The plating solution in accordance with the invention suitable for giving a metallic substrate a protective coating based on chromium, comprising a chromium matrix in which solid particles are distributed, characterized in that it contains trivalent chromium with a concentration of between 5 and 150 g per liter of plating solution and preferably between 25 and 50 g per liter of plating solution, solid particles with a concentration of between 1 and 100 g per liter of plating solution and preferably between 5 and 50 g per liter of plating solution.

The examinations made by means of microanalysis, in optical microscopy and scanning electron microscopy, on sections of the platings confirm the nature of the coating obtained and demonstrate the presence in the chromium matrix of particles of the same kind and size as those of the particles introduced into the plating solution before the electrolysis and exhibiting a really homogeneous distribution in the plating.

In particular, it is clearly apparent that these particles are completely encapsulated in the chromium matrix constituting the plating, but apart from this there would seem to be no fundamental modifications in the general visual appearance of the plating obtained. The coating is dense and homogeneous, and has a smooth surface.

Figure 1:
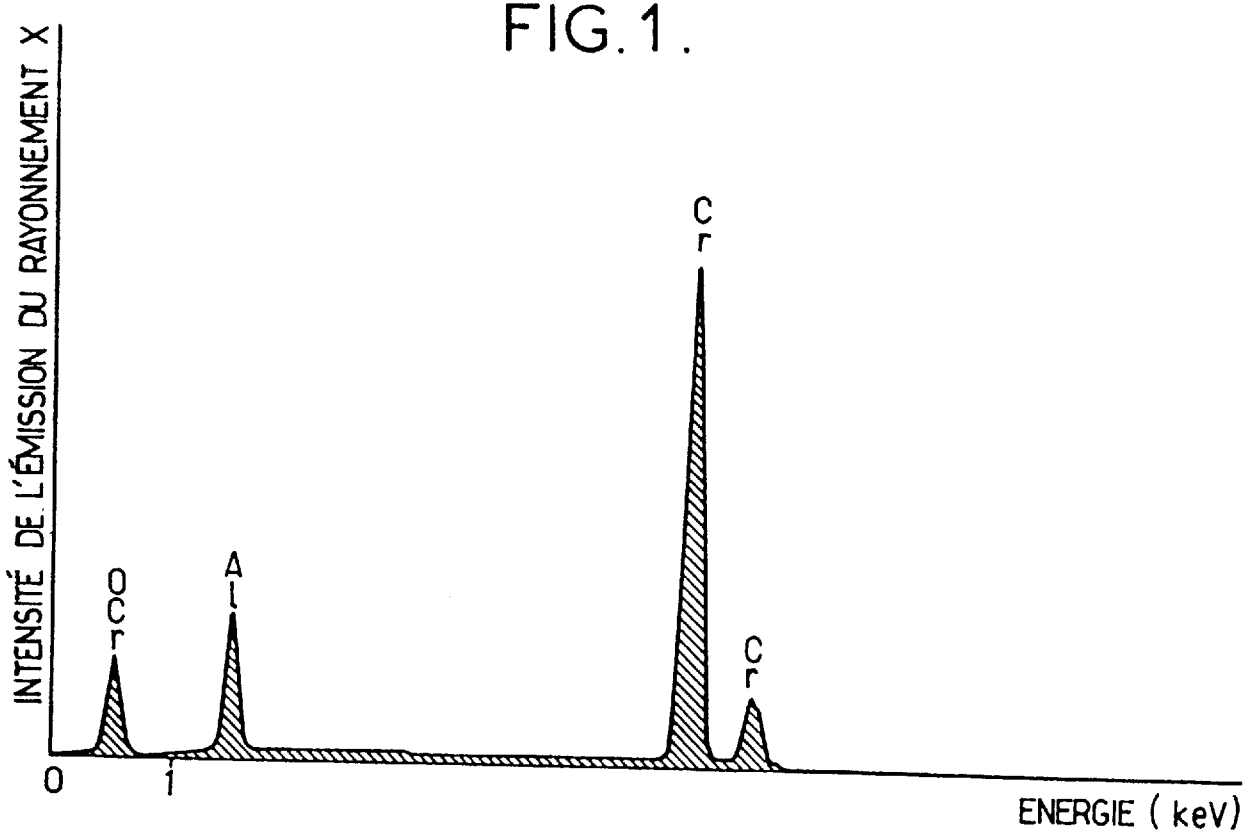
FIGS. 1 and 2 are X-ray spectra of specimens prepared in accordance with the process of the invention.
Figure 2:
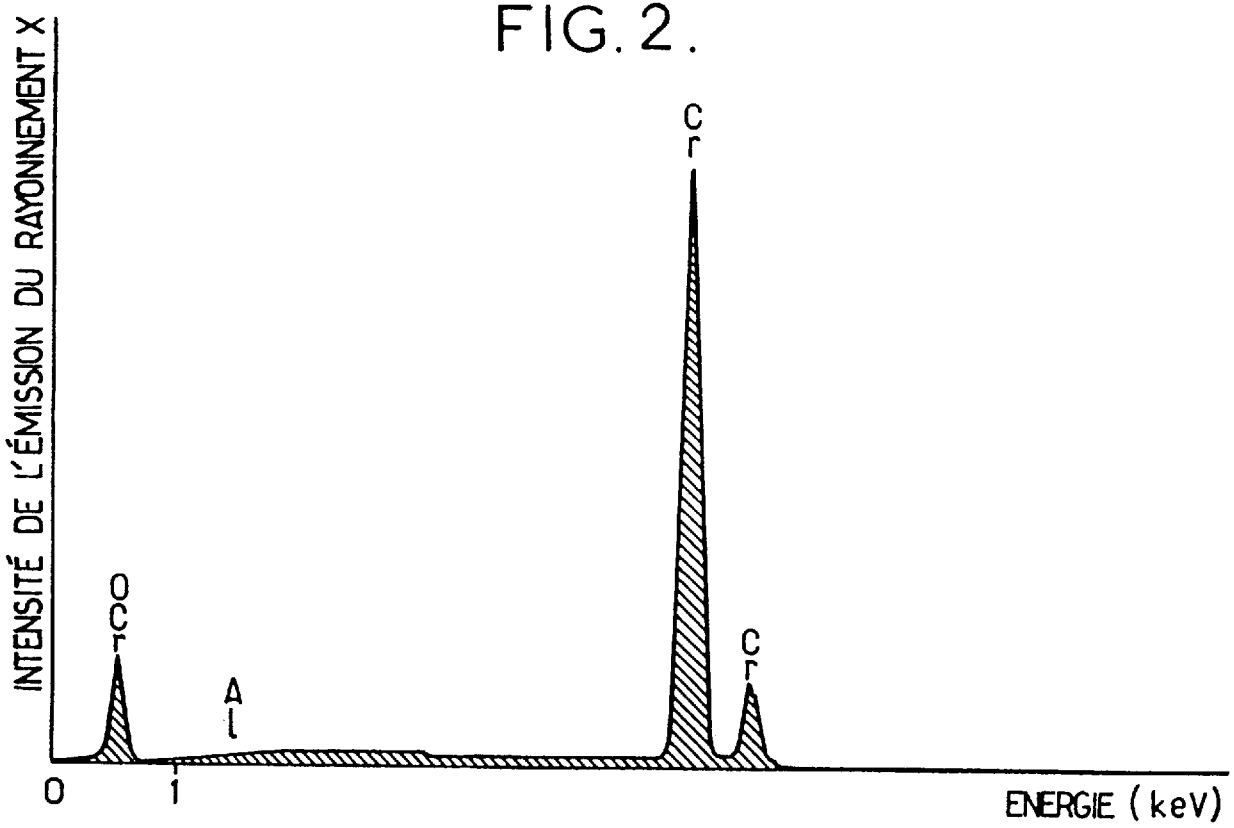
Figure 3:
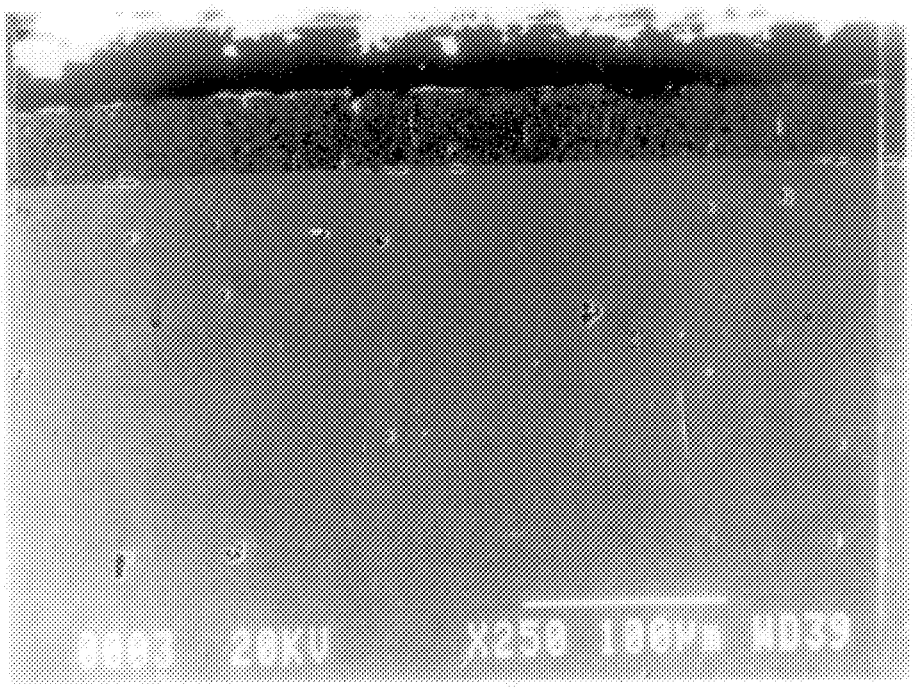
FIGS. 3 to 5 are scanning electron microscopy photographs of sections of chromium platings according to the invention.
Figure 4:
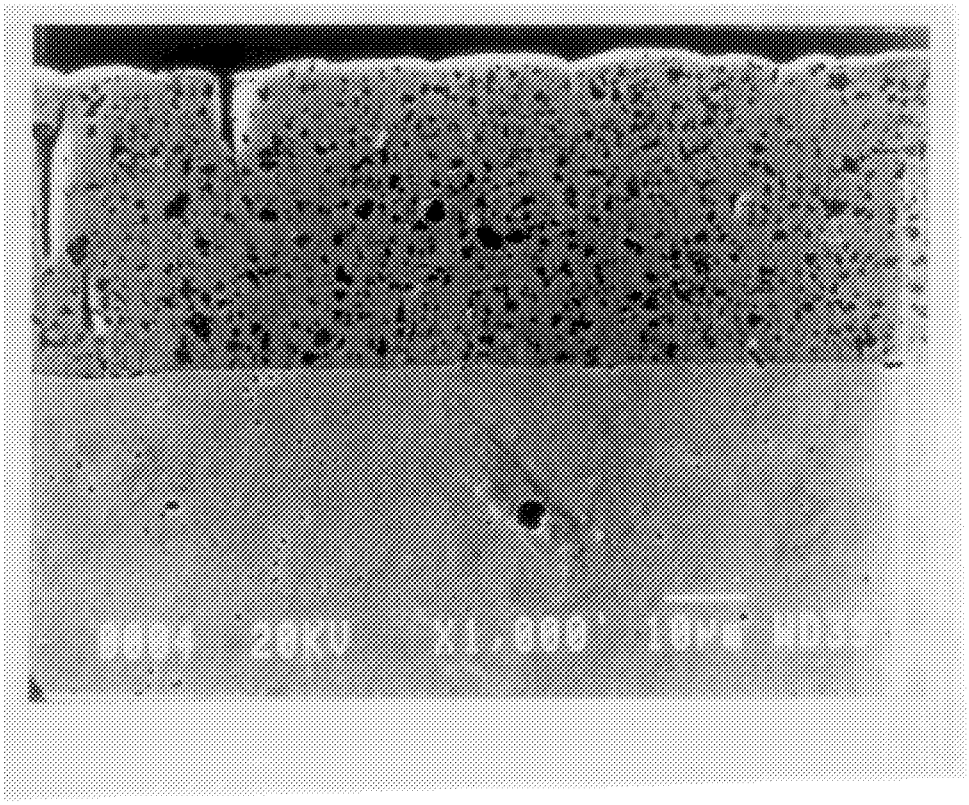
Figure 5:
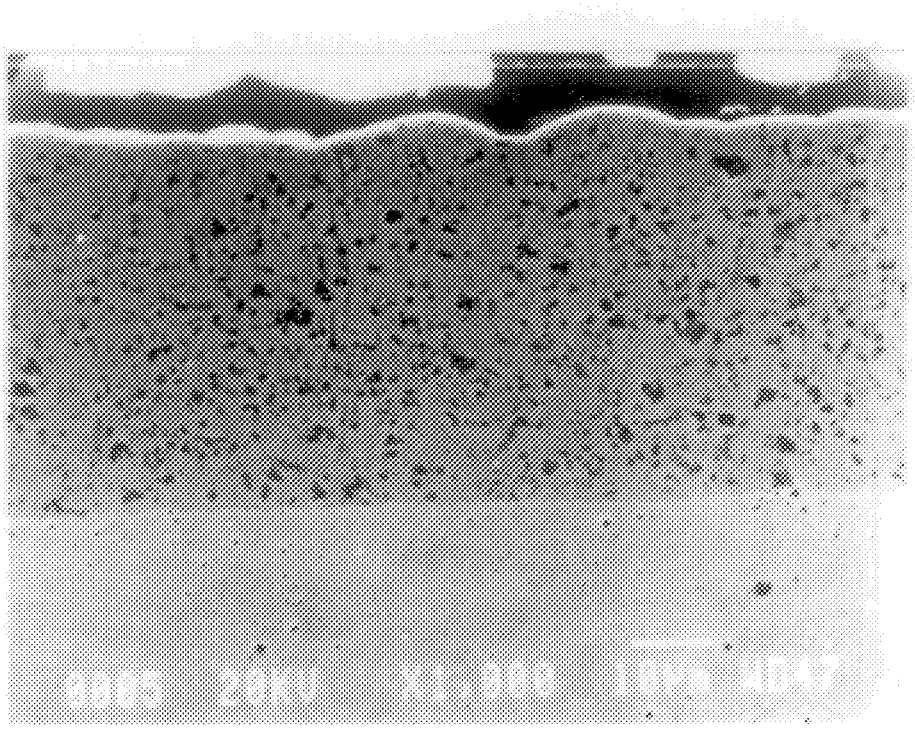
Figure 6:
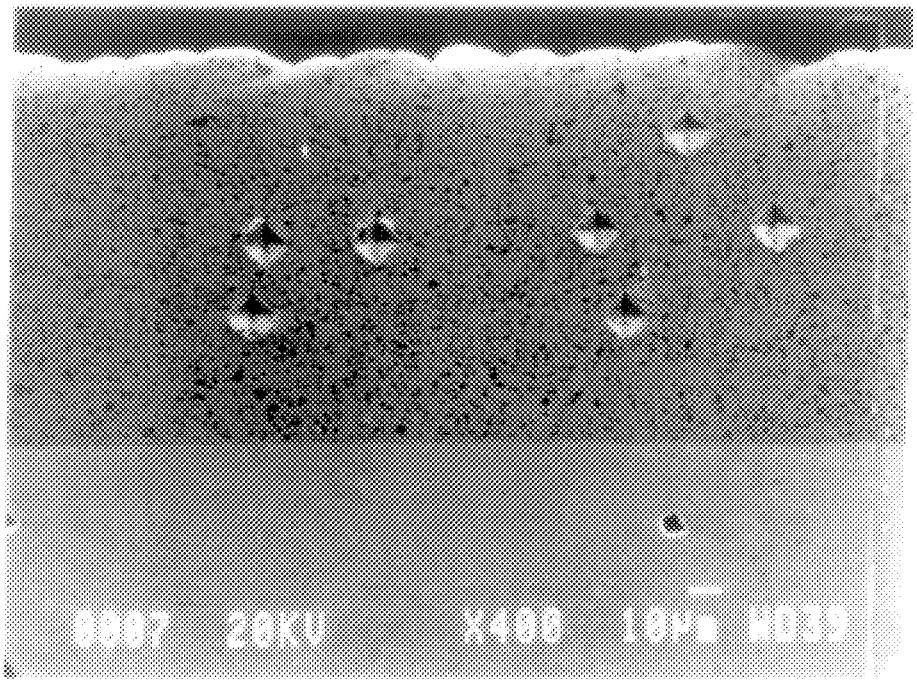
FIGS. 6 to 7 are photographs showing the Vickers microhardness impressions.
Figure 7:
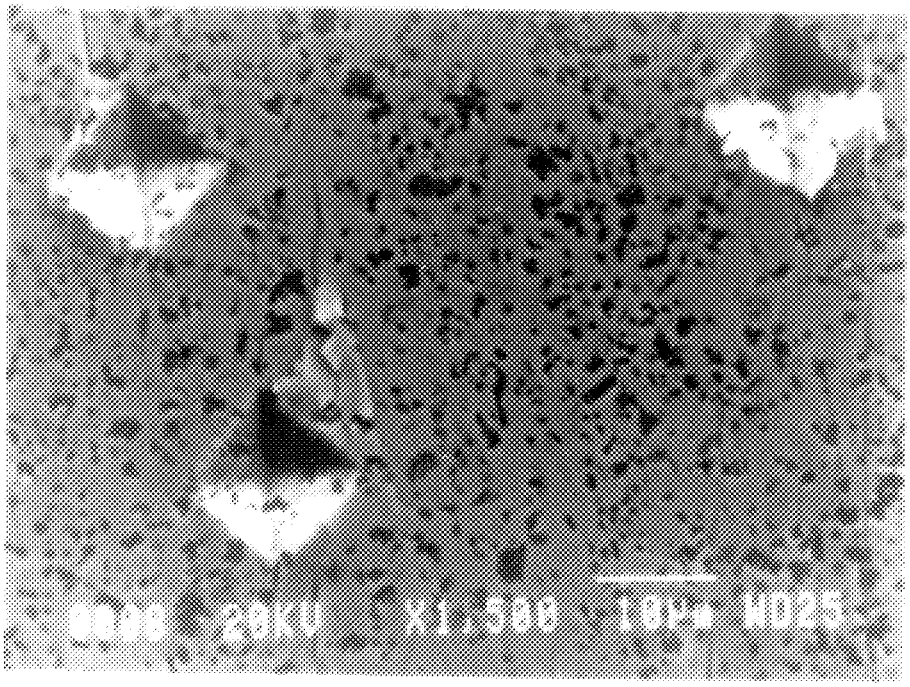

In order to illustrate some of these tests, but without this being able to limit the field of application, the Applicant Company, in Photographs FIGS. 3 to 7 and in FIGS. 1 and 2, gives an idea of the results obtained:

FIGS. 3 to 5 were taken using scanning electron microscopy on sections of chromium platings obtained by electrolysis of an aqueous trivalent chromium solution obtained from the reduction of chromic acid, the said solution containing in suspension particles of alumina ($Al_2O_3$) having a size varying between 0.2 and 0.6 $\mu$m. Photographs 1 to 3 were taken on the same specimen. Photograph 1 was obtained with a magnification of 250 and Photographs 2 and 3 with a magnification of 1000 at two different points in the specimen. It may be seen that there is a homogeneous distribution of the particles throughout the plating, as well as perfect adhesion of this plating, characterized by the plating/substrate interface. In the case of this specimen, the average thickness is from approximately 30 to 40 μm;

FIGS. 6 and 7 show the Vickers microhardness impressions, made with a 100 g load, in an approximately 100 μm layer of a chromium plating obtained using a trivalent chromium solution obtained from the reduction of chromic acid, the said solution containing alumina particles in suspension. This microhardness may be estimated to be approximately 1050–1100 Hv.

FIGS. 1 and 2 are spectra obtained by X-ray microanalysis on specimens prepared in accordance with the process according to the invention. They demonstrate the nature of the inclusions. The horizontal axis represents the energy of the X-rays emitted; it is expressed in kiloelectronvolts (keV). The vertical axis represents the intensity of the X-ray emission.

FIG. 1 is an X-ray microanalysis spectrum (approximately 1 $\mu m^2$ beam) obtained from the points containing the inclusions. Clearly apparent here is the aluminum $K_\alpha$ X-ray fluorescence peak, as well as the chromium $K_\alpha$ and $K_\beta$ lines.

FIG. 2 is an X-ray microanalysis spectrum from the part of the plating having no inclusions. This microanalysis was carried out with the sole purpose of demonstrating the presence of alumina particles in the plating.

According to the invention, it therefore seems to be possible to codeposit particles, whose nature and size may be varied, in the chromium matrix homogeneously:

without substantially modifying either the nature of the current or its intensity during the period of electrolysis, without necessarily adding (although this is possible) compounds other than those necessary for putting the particles into solution in good condition, especially without complexing agents, from a trivalent chromium solution obtained by the reduction of chromium trioxide ($CrO_3$) generally in the form of chromic acid (in aqueous solution) by various chemical reducing agents in various reaction mediums. Adding inorganic or organic compounds to the solution (surface-active agents, agents improving the conductivity of the solution, or complexing or chelating agents) may alter the electrodeposition conditions but does not appreciably alter the characteristics of the composite plating.

The experiments carried out have shown that it is possible, in accordance with the invention, to produce platings of a few microns in thickness to several tens and even hundreds of microns with particles whose size may vary from a few ängströms to several tens of microns.

The solid particles which were used are of a nature as variable as alumina, silicon carbide, chromium oxide, boron nitride or PTFE (polytetrafluoroethylene). According to the invention, it is clearly possible, using this method, to codeposit any other type of particle, polarizable or nonpolarizable, metallic or nonmetallic, conductive or non conductive, organic or inorganic, synthetic or natural, in order to alter the physical characteristics of the chromium plating.

In other words, any particle which can be put into suspension without causing a parasitic chemical reaction in the trivalent chromium solution used can be employed to serve as an inclusion within the scope of the invention.

Having described the invention in a general manner, in order to allow any person skilled in the art to be able to carry out the preparation of the necessary solution in a reliable and simple manner and to produce the platings with inclusions in the same manner, we will now give a few examples realized within the spirit of this process. These examples are not limiting in the application of the process, but are given solely to illustrate how this process is carried out.

EXAMPLE 1

A trivalent chromium electrolysis solution was prepared according to the method described in Patent EP 0,099,793. This solution had a trivalent chromium ion concentration of 30 g/l. The pH of this solution was brought close to 0 by adding hydrochloric acid. We added 50 g/l of alumina having a size of from 0.2 to 0.5 μm and, after vigorously stirring and keeping the alumina in suspension throughout all the operations, by blowing in air via the bottom of the tank, we produced a chromium plating (by electrolysis) on a metallic substrate placed as the cathode with a current density of 60 $A/dm^2$, the plating solution was at a temperature of 50° C. and the anode consisted of platinized titanium.

The electrolysis lasted 30 minutes and, after electrolysis, we examined the appearance of the plating obtained on the component immersed (a metal cylinder 10 mm in diameter and 70 mm in height): it appeared to be smooth, semi-bright, dense and adherent. The thickness of the plating obtained on this metal cylinder, calculated using the difference in mass was 60 μm. After examination in section, the plating turned out to have a thickness of between 62 and 66 μm, with a homogeneous distribution of the inclusions, the amount of which, estimated by image analysis, was approximately 15%.

EXAMPLE 2

Starting with a solution of the same type as for Example 1, with a solution having a $Cr^{3+}$concentration of 40 g/l, the pH was brought close to 0 by adding sulfuric acid and fluosilicic acid and the temperature was 45° C.

We added 15 g/l of titanium carbide (TiC) having a size of from 2 to 5 μm and we carried out the electrolysis with a current density of 80 $A/dm^2$. Under the same conditions as above for Example 1, apart from the fact that the anode is made of graphite, for a duration of 10 minutes, we were able to deposit an approximately 30 μm adherent, smooth, bright and hard layer. Sectional examination of this layer, in the scanning electron microscope, demonstrated the presence of TiC inclusions in an amount estimated to be approximately 10%.

The Vickers microhardness under a load of 100 g was measured and found to be equal to 1150 Hv.

EXAMPLE 3

Starting from a trivalent chromium solution prepared by reduction of an aqueous solution of chromic acid in fluoroboric acid medium by methanol, we obtained a solution whose trivalent chromium concentration was 60 g of $Cr^{3+}$ per liter and the pH was brought to approximately 0 by adding hydrofluoric acid.

We added approximately 25 g/l of PTFE by means of a solution which contained 0.5 to 1 μm particles in solution in an ionic compound enabling the PTFE particles to remain in suspension: this solution is a concentrate with 600 g/l of PTFE.

We carried out the electrolysis with a current density of 45 $A/dm^2$, the plating solution was at a temperature of 55° C., the plating solution being stirred by a rotating magnetic stirrer, and the plating was produced on a plane metal component having an area of 20 $dm^2$.

The electrolysis, lasting 40 minutes, produced an approximately 60 μm plating which had a bright appearance at the center of the sheet and increasingly matt on going out to the edges. Using optical microscopy, we found inclusions present, these being distributed homogeneously in the plating and having a concentration estimated to be approximately 10%.

EXAMPLE 4

We have produced, on cylindrical test specimens, thick chromium platings having a thickness varying from 10 to 50 μm by means of various chromium-plating solutions in which the chromium was in the oxidation state VI. These solutions were commercially available solutions with, as catalyst, compounds known to the person skilled in the art and/or patented compounds, the composition of which is well known. After a surface treatment on each test specimen, in order to enable the chromium layer with inclusions to stick (for example, anodic depassivation in sulfuric medium), we produced electroplatings having a chromium layer with inclusions according to the method described in Example 1.

After electrolysis lasting 30 minutes, we examined, in section, various platings obtained. All had a chromium layer without inclusions, which seemed to be that obtained using the hexavalent chromium plating solutions, and, superimposed, a chromium layer with inclusions. Examination of these multilayers in the scanning electron microscope revealed very sound layer/layer and layer/substrate interfaces, testimonies of good adhesion.

What is claimed is:

1. A process for providing a substrate with a protective coating based on chromium, said protective coating comprising a chromium matrix in which solid particles are distributed, said process comprising electrodepositing said protective coating on a substrate by passing an electric current between at least one cathode comprising said substrate to be coated and at least one anode, said at least one cathode and said at least one anode being immersed in an electroplating solution consisting essentially of an aqueous solution comprising trivalent chromium obtained from a reduction of chromic acid by a reducing agent, and said solid particles, said electroplating solution being devoid of complexing agents.

2. The process according to claim 1, wherein said electroplating solution consists essentially of said trivalent chromium at a concentration of between about 5 and about 150 g per liter of said electroplating solution, and said solid particles at a concentration of between about 1 and about 100 g per liter of electroplating solution.

3. The process according to claim 2, wherein the concentration of trivalent chromium is between about 25 and about 50 g per liter of electroplating solution.

4. The process according to claim 2, wherein the concentration of solid particles is in a range between about 5 g per liter and about 50 g per liter of electroplating solution.

5. The process according to claim 1, wherein said electroplating solution is stirred.

6. The process according to claim 5, wherein the temperature of the electroplating solution is between about 40° and about 55° C.

7. The process according to claim 5, comprising maintaining the current density at a value of between about 30 and about 80 $A/dm^2$.

8. The process according to claim 1, wherein said electroplating solution comprises a temperature of between about 20° and about 60° C.

9. The process according to claim 1, comprising maintaining a current density at a value of between about 5 and about 150 $A/dm^2$.

10. An electroplating solution suitable for providing a metallic substrate with a protective coating based on chromium, said protective coating comprising a chromium matrix in which solid particles are distributed, said electroplating solution consisting essentially of trivalent chromium, obtained from reduction of chromic acid by a reducing agent, at a concentration of between about 5 and about 150 g per liter of electroplating solution, and said solid particles at a concentration of between about 1 and about 100 g per liter of electroplating solution, said electroplating solution being devoid of complexing agents.

11. The electroplating solution according to claim 10, wherein the trivalent chromium comprises between about 25 and about 50 g per liter of the electroplating solution.

12. The electroplating solution according to claim 10, wherein the solid particles comprise between about 5 and about 50 g per liter of the electroplating solution.

* * * * *